US011767692B2

(12) United States Patent
Schutt

(10) Patent No.: US 11,767,692 B2
(45) Date of Patent: Sep. 26, 2023

(54) VEHICLE DOOR LATCH SAFETY SENSOR ARRANGEMENT

(71) Applicant: SAF-HOLLAND, Inc., Muskegon, MI (US)

(72) Inventor: Randy L. Schutt, Holland, MI (US)

(73) Assignee: SAF-Holland, Inc., Muskegon, MI (US)

( * ) Notice: Subject to any disclaimer, the term of this patent is extended or adjusted under 35 U.S.C. 154(b) by 1358 days.

(21) Appl. No.: 16/184,562

(22) Filed: Nov. 8, 2018

(65) Prior Publication Data

US 2019/0136591 A1 May 9, 2019

Related U.S. Application Data

(60) Provisional application No. 62/583,842, filed on Nov. 9, 2017.

(51) Int. Cl.

| | |
|---|---|
| ***E05B 81/64*** | (2014.01) |
| ***E05B 83/10*** | (2014.01) |
| ***E05B 81/66*** | (2014.01) |
| ***E05B 81/70*** | (2014.01) |

(52) U.S. Cl.

CPC ..... *E05B 83/10* (2013.01); *E05B 81/64* (2013.01); *E05B 81/66* (2013.01); *E05B 81/70* (2013.01)

(58) Field of Classification Search

CPC ..... E05B 83/10; E05B 81/64; E05B 81/66; E05B 81/70

See application file for complete search history.

(56) References Cited

U.S. PATENT DOCUMENTS

| | | | | |
|---|---|---|---|---|
| 3,924,256 | A * | 12/1975 | Cohen | G08B 29/00 340/508 |
| 4,688,244 | A | 8/1987 | Hannon et al. | |
| 4,750,197 | A | 6/1988 | Denekamp et al. | |
| 5,168,258 | A * | 12/1992 | Radke | E05B 67/38 70/DIG. 49 |
| 6,281,793 | B1 | 8/2001 | Haimovich et al. | |
| 6,390,529 | B1 * | 5/2002 | Bingle | E05B 79/20 292/DIG. 43 |
| 6,400,266 | B1 | 6/2002 | Brown, Jr. | |
| 7,049,914 | B2 * | 5/2006 | Lamb | E05B 81/66 335/207 |
| 7,068,162 | B2 | 6/2006 | Maple et al. | |

(Continued)

FOREIGN PATENT DOCUMENTS

DE 102017108291 A1 * 10/2018

*Primary Examiner* — Carlos Lugo
(74) *Attorney, Agent, or Firm* — Price Heneveld LLP

(57) ABSTRACT

A vehicle door latch safety sensor arrangement includes a vehicle body, a door coupled to the vehicle body, a latch arrangement and a sensor arrangement including a door sensor and configured to sense when the door is in the closed position, a latch sensor configured to sense when a latch member is in the engaged position, and a handle sensor configured to sense when a handle is in the closed position, and a controller operably coupled to the sensors and configured to provide feedback to the operator of at least one of (a) whether the door is in a closed position, the latch member is in an engaged position and the handle member is in a locked position, and (b) whether at least one of the door is in an open position, the latch member is in a disengaged position, and the handle member is in the an unlocked position.

28 Claims, 3 Drawing Sheets

(56) References Cited

U.S. PATENT DOCUMENTS

| | | | |
|---|---|---|---|
| 7,154,394 | B2 | 12/2006 | Zhou |
| 7,242,296 | B2 | 7/2007 | Wang et al. |
| 7,317,387 | B1 | 1/2008 | Cova et al. |
| 7,339,473 | B2 | 3/2008 | Lucas |
| 7,436,298 | B2 | 10/2008 | Rajapakse et al. |
| 7,538,672 | B2 | 5/2009 | Lockyer et al. |
| 7,733,225 | B2 | 6/2010 | Zhou et al. |
| 7,828,342 | B2 | 11/2010 | Terry et al. |
| 7,883,128 | B2 | 2/2011 | Terry et al. |
| 7,916,016 | B2 | 3/2011 | Auerbach et al. |
| 7,978,065 | B2 | 7/2011 | Schnitz et al. |
| 8,026,792 | B2 | 9/2011 | Powers et al. |
| 8,058,985 | B2 | 11/2011 | Dobson et al. |
| 8,069,693 | B2 | 12/2011 | Powers et al. |
| 8,111,157 | B2 | 2/2012 | Diener et al. |
| 8,138,917 | B2 | 3/2012 | Diener et al. |
| 8,154,404 | B2 | 4/2012 | Diener et al. |
| 8,319,640 | B2 | 11/2012 | Mcginnis et al. |
| 8,446,278 | B2 | 5/2013 | Ivashin et al. |
| 9,345,617 | B2 | 5/2016 | Jain et al. |
| 2008/0018438 | A1 | 1/2008 | Ehrlich et al. |
| 2010/0265069 | A1 | 10/2010 | Michaels et al. |
| 2012/0112910 | A1 | 5/2012 | Meyers |
| 2015/0371511 | A1 | 12/2015 | Miller et al. |

* cited by examiner

VEHICLE DOOR LATCH SAFETY SENSOR ARRANGEMENT

BACKGROUND OF THE INVENTION

The embodiments described herein relate to a door latch sensor arrangement, and in particular to a door latch sensor arrangement used in conjunction with heavy-duty, commercial semi-trailer vehicles, where the sensor arrangement is adapted to sense whether a door, a door latch member and a handle member are in the proper position, and further whether the sequence in which each of the door, the latch member and the handle member were moved into the proper position to correctly and safely secure the door in a closed position.

BRIEF SUMMARY OF THE INVENTION

One embodiment provides a vehicle door latch safety sensor arrangement that includes a vehicle body, and a door operably coupled to the vehicle body and moveable between an open position and a closed position. The embodiment also includes a latch arrangement that includes a latch member moveable between an engaged position where the latch member engages the vehicle body preventing the door from being moved from the closed position to the open position, and a disengaged position where the latch member is disengaged from the vehicle body thereby allowing the door to be moved from the closed position to the open position, and a handle member configured to be grasped by an operator and operably coupled to the latch member, the handle member moveable between a first position where the latch member is in the engaged position and a second position where the latch member is in the disengaged position, wherein the handle member is moveable between a locked position where the handle member is engaged with the vehicle body thereby preventing the handle member from being moved from the first position to the second position and an unlocked position where the handle member is disengaged from the vehicle body thereby allowing the handle member to be moved from the first position to the second position. The embodiment further includes a sensor arrangement that includes a door sensor located proximate the door and configured to sense when the door is in the closed position, a latch sensor located proximate the first latch member and configured to sense when the latch member is in the engaged position, and a handle sensor located proximate the handle member and configured to sense when the handle member is in the locked position, and a controller operably coupled to the door, latch and handle sensors and configured to provide feedback to the operator of at least one of (a) whether the door is in the closed position, the latch member is in the engaged position and the handle member is in the locked position, and (b) whether at least one of the door is in the open position, the latch member is in the disengaged position, and the handle is in the unlocked position.

Another embodiment includes a method for sensing proper door latch arrangement configuration that includes providing a vehicle body, providing a door operably coupled to the vehicle body and moveable between an open position and a closed position, and providing a latch arrangement, the latch arrangement including a latch member moveable between an engaged position where the latch member engages the vehicle body preventing the door from being moved from the closed position to the open position, and a disengaged position where the latch member is disengaged from the vehicle body thereby allowing the door to be moved from the closed position to the open position, and a handle member configured to be grasped by an operator and operably coupled to the latch member, moveable between a first position where the latch member is in the engaged position and a second position where the latch member is in the disengaged position, wherein the handle member is moveable between a locked position where the handle member is engaged with the vehicle body thereby preventing the handle member from being moved from the first position to the second position and an unlocked position where the handle member is disengaged from the vehicle body thereby allowing the handle member to be moved from the first position to the second position. The method also includes providing a sensor arrangement that includes a door sensor located proximate the door and configured to sense when the door is in the closed position, a latch sensor located proximate the latch member and configured to sense when the latch member is in the engaged position, and a handle sensor located proximate the handle member and configured to sense when the handle member is in the locked position, and providing a controller operably coupled to the door, latch and handle sensors. The method further includes sensing whether the door is in the closed position and communicating the same with the controller, sensing whether the latch is in the engaged position and communicating the same with the controller, sensing whether the handle member is in the locked position and communicating the same with the controller, and providing feedback to the operator of at least one of (a) whether the door is in the closed position, the first latch member is in the engaged position and the handle member is in the locked position, and (b) whether at least one of the door is in the open position, the latch member is in the disengaged position, and the handle is in the unlocked position.

The principal objects of the embodiments as shown and illustrated herein are to provide a door latch sensor arrangement that increases the safety of vehicle operation by assuring proper sequencing of a door closing, latching and locking process, and provides necessary feedback to an operator to verify the same.

These and other advantages of the invention will be further appreciated and understood by those skilled in the art by reference to the following written descriptions, claims and appended drawings.

DETAILED DESCRIPTION OF THE PREFERRED EMBODIMENTS

Figure 1:
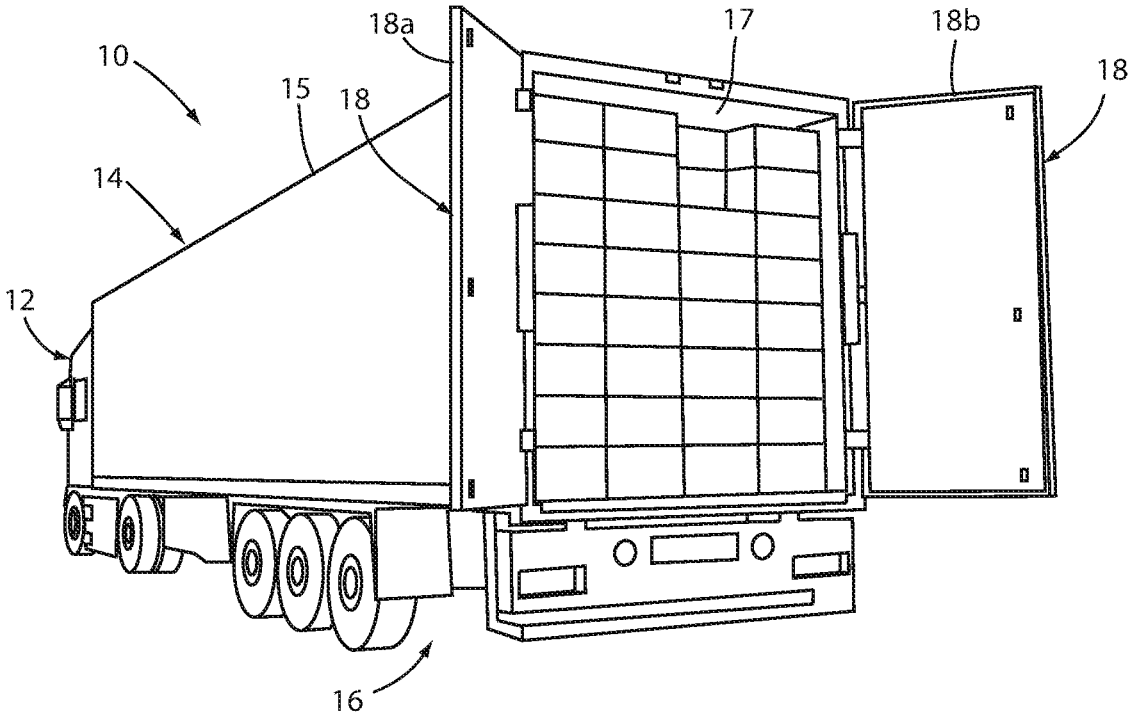
FIG. 1 is a perspective view of a truck and trailer arrangement, where the trailer includes doors positioned in an open position.
Figure 3:
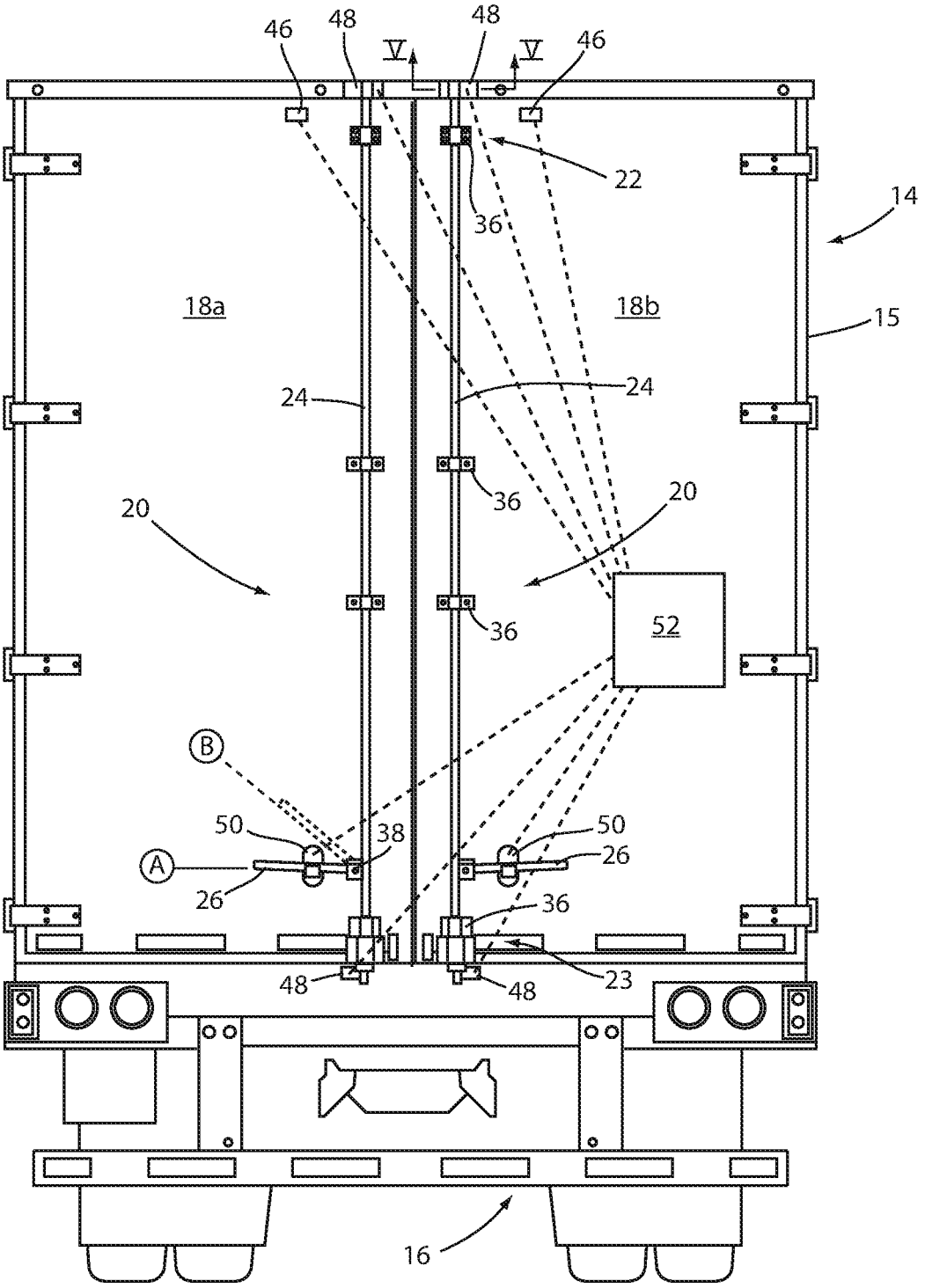
FIG. 3 is a rear elevational view of the trailer.

For purposes of description herein, the terms "upper," "lower," "right," "left," "rear," "front," "vertical," "horizontal," and derivatives thereof shall relate to the invention as oriented in FIGS. 1 and 3. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other characteristics relating to the embodiments disclosed herein are not to be considered as limiting, unless the claims expressly state otherwise.

Figure 2:
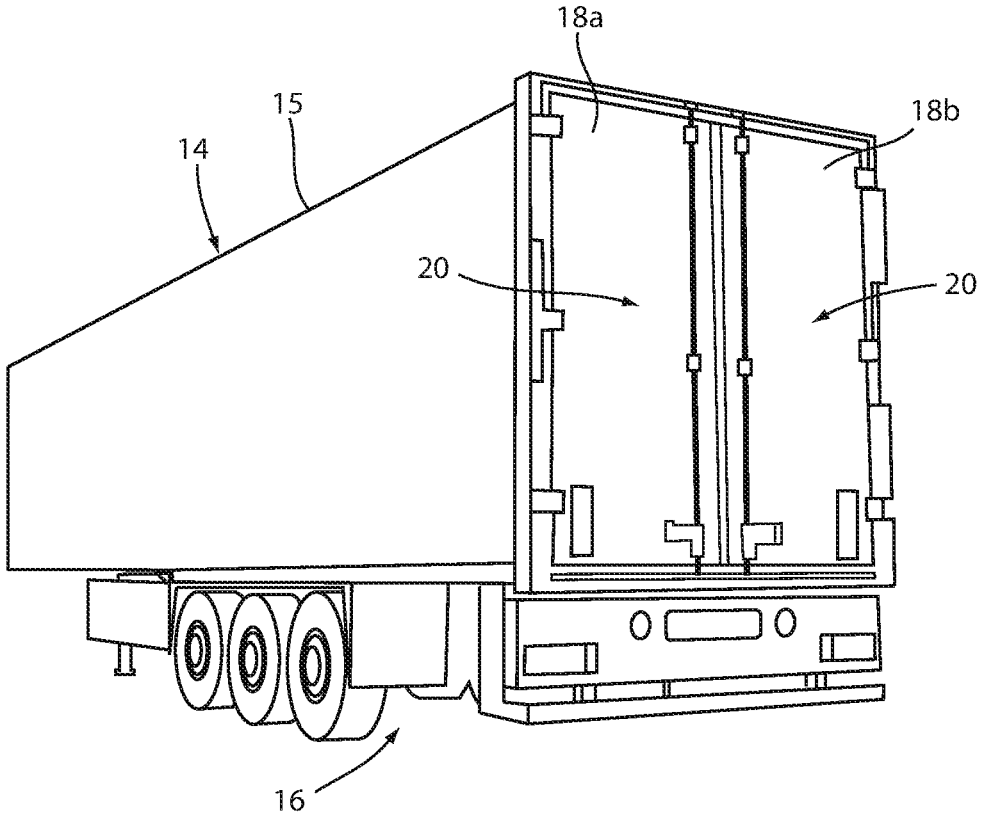
FIG. 2 is a perspective view of the trailer, where the doors are positioned in a closed position.

Reference numeral 10 (FIG. 1) generally designates a vehicle arrangement that includes a towing vehicle such as a semi-truck or tractor 12 and a towed vehicle such as a heavy-duty, commercial trailer 14. The trailer 14 includes a vehicle body 15 supported by a suspension assembly 16 and defining an interior cargo space 17. The trailer 14 includes a pair of doors 18 pivotably coupled to a rear portion of the vehicle body 15 such that the doors 18 are moveable between an open position as shown in FIG. 1, and a closed position as shown in FIG. 2. In the illustrated example, the doors 18 include a first door 18*a* and a second door 18*b*.

A pair of latch arrangements 20 (FIGS. 2 and 3) secure the doors 18*a*, 18*b* in the closed position. In the illustrated example, each latch arrangement 20 includes an upper latch assembly 22 and a lower latch assembly 23, a link member or locking bar 24 extending between the upper latch assembly 22 and the lower latch assembly 23, and a handle member 26 operably coupled to the link member 24. Specifically, each latch assembly 22, 23 includes a latch body 28 (FIG. 4) secured to the vehicle body 15 and a latch member 30 releasably engaging the latch body 28. In the illustrated example, the latch body 28 is C-shaped and includes a body portion 31 and an abutment arm 32 extending outwardly from the body portion 31. The latch member 30 includes a first abutment surface 33 and a second abutment surface 34. The latch member 30 is fixed to an end of the link member 24 such that when the link member 24 is pivoted in a direction 35 the latch member 30 is moved from an unlatched or disengaged position E, to a latched or engaged position F where the first abutment surface 33 abuts the abutment arm 32 and the second abutment surface 34 abuts the body portion 31 of the latch body 28.

Figure 5:
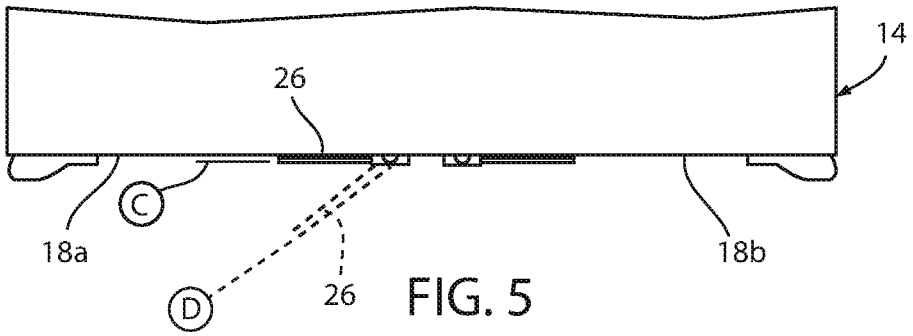
FIG. 5 is a partial top plan view of a rear portion of the trailer.
Figure 6:
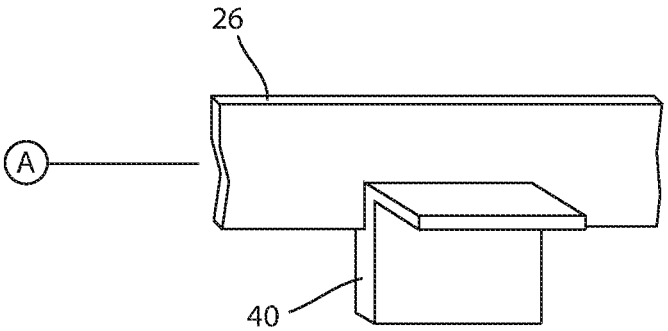
FIG. 6 is a partial perspective view of a handle arrangement.

As best illustrated in FIG. 3, the link member 24 is pivotably coupled to a rear surface of the associated door 18 by a plurality of U-shaped connectors 36. The handle member 26 is pivotably coupled to the link member 24 along the length of the link member 24 at a pivot point 38 such that the handle member 26 may be pivoted between a locked position A and an unlocked position B. Once the handle member is moved from the locked position A to the unlocked position B, the handle member 26 may then be rotated outwardly away from the associated door 18 from a first position C (FIG. 5), corresponding to the engaged position for the latch member 30, to a second position D, which moves the latch member 30 from the engaged position F to the disengaged position E, which in turn allows the associated door 18 to be moved from the closed position to the open position. As best illustrated in FIG. 6, the handle member 26 rests upon and behind a lock rest 40 which prevents the handle member 26 from being moved from the first position C to the second position D until the handle member 26 is moved from the locked position A to the unlocked position B. As noted above, each door 18*a*, 18*b* is secured in the closed position by a corresponding latch arrangement 20. It is further noted that each of the doors 18*a*, 18*b* are configured such that the first door 18*a* must be moved from the open to the closed position before the second door 18*b* can be moved from the open position to the closed position.

Figure 4:
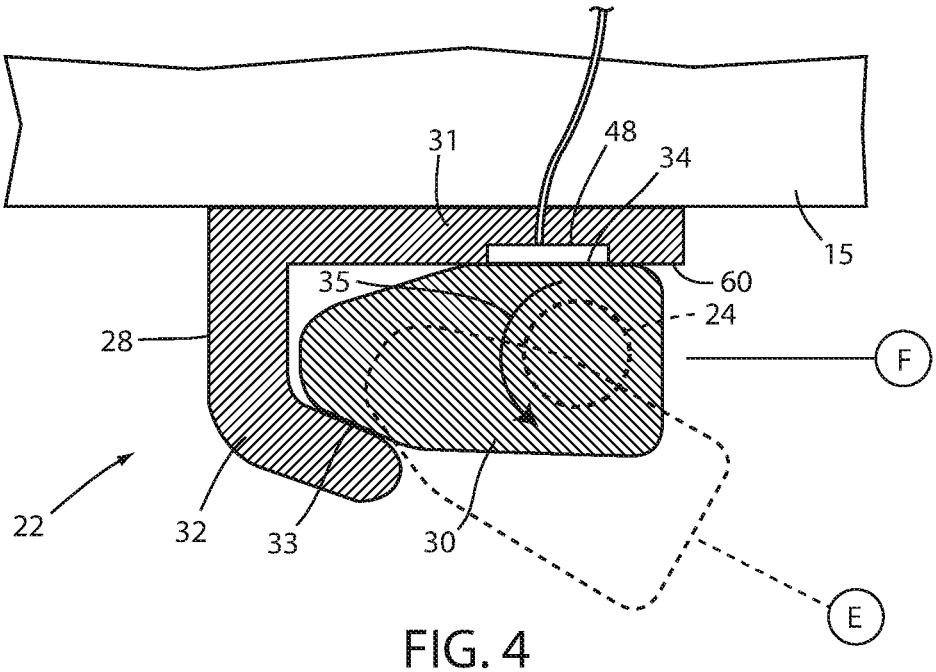
FIG. 4 is a cross-sectional view of a latching arrangement taken the through line V-V, FIG. 3.

A sensor arrangement includes a plurality of sensors, including door sensors 46 located proximate the doors 18*a*, 18*b* and configured to sense when the associated doors 18*a*, 18*b* are in the closed position, latch sensors 48 located proximate corresponding upper and lower latch assemblies 22, 23 configured to sense when the associated latch member 30 is in the engaged position, and handle sensors 50 located proximate the handle members 26 and configured to sense when the associated handle member 26 is in the locked position. By way of example, a latch sensor 48 is illustrated in FIG. 4. The sensors 46, 48, 50 may comprise proximity sensors, such as a Hall effect type sensor, however other proximity type switches or sensors may be used, including inductive sensors and magnetic reed sensors, as well as other sensing arrangements or sensors including mechanical switches, optical switches, pressure sensing switches, and rotation angle sensors. By way of example, the latch sensor 48 (FIG. 4) is positioned proximate an outer surface 60 of the body portion 31 of the latch body 28 such that the Hall effect latch sensor 48 senses the ferrous metal of the latch member 30 as being properly located within the engaged position F.

A controller 52 is operably coupled to the door sensors 46, the latch sensors 48 and the handle sensors 50. The controller 52 is configured to provide feedback to the operator in the form of a warning light positioned within a cabin of the truck 12 when the controller receives a signal from the sensors 46, 48 and/or 50 when either of the doors 18*a*, 18*b* is in the closed position, that the latch members 30 are in the engaged position and/or that the handle members 26 are in the locked position. It is noted that warning light may alternatively be placed at other locations around the vehicle, including in a location where the warning light would be visible to the operator via a rear view mirror located internal or external to the cabin of the truck 12. The controller 52 may also be configured to provide feedback to the operator if at least one of the doors 18*a*, 18*b* is in the open position, the latch members 30 are in the disengaged position, and/or if the handle members 26 are in the unlocked position. Preferably, the controller 52 is configured to provide a warning to the operator if the doors 18*a*, 18*b*, latch arrangements 20 and handle members 26 are not operated in the correct sequence. Specifically, the controller 52 may be configured to provide a warning to the operator if the sensors 46, 48, 50 fail to sense that the doors 18 are positioned in the closed position prior to the sensors 46, 48, 50 sensing that the latch members are moved to the engaged position prior to the sensors 46, 48, 50 sensing that the handle member is positioned in the locked position. The controller 52 may be further configured to send a warning to the operator if the doors 18*a*, 18*b* were not closed in the proper sequence with respect to one another. The necessary sequential steps assure that the doors are properly closed and the latch systems properly engaged prior to the door handles being moved to the locked position, thereby assuring that the doors are properly and safely secured in the closed position, thereby reducing the chances that the doors are improperly latched and accidentally open during operation of the associated vehicle.

In the foregoing description, it will be readily appreciated by those skilled in the art that modifications may be made to the embodiments disclosed herein without departing from the concepts as disclosed herein. Such modifications are to be considered as included in the following claims, unless these claims by their language expressly state otherwise.

The invention claimed is:

1. A vehicle arrangement, comprising:

a vehicle body;

first and second doors, wherein each door is operably coupled to the vehicle body and moveable between an open position and a closed position and wherein the first and second doors are configured such that the first door must be moved to the closed position before the second door can be moved from the open position to the closed position in order to properly close the first and second doors;

a latch arrangement associated with each door, each latch arrangement comprising:

a latch member moveable between an engaged position where the latch member operably engages the vehicle body preventing the associated door from being moved from the closed position to the open position, and a disengaged position where the latch member is operably disengaged from the vehicle body thereby allowing the associated door to be moved from the closed position to the open position; and a handle member disposed on an outside of the associated door, wherein the handle member is configured to be grasped by an operator from outside the vehicle body while the associated door is closed, and operably coupled to the latch member, the handle member moveable between a first position where the latch member is in the engaged position and a second position where the latch member is in the disengaged position, wherein the handle member is moveable between a locked position where the handle member is operably engaged with at least one of the associated door and the vehicle body thereby preventing the handle member from being moved from the first position to the second position and an unlocked position where the handle member is operably disengaged from the associated door and the vehicle body thereby allowing the handle member to be moved from the first position to the second position;

a sensor arrangement associated with each door, each sensor arrangement comprising:

a door sensor located proximate the associated door and configured to sense when the associated door is in the closed position;

a latch sensor located proximate the first latch member and configured to sense when the latch member is in the engaged position; and a handle sensor located proximate the handle member and configured to sense when the handle member is in the locked position; and a controller operably coupled to the door, latch and handle sensors, wherein the controller is configured to provide a warning if the latch sensor senses that the latch member is in the engaged position before the door sensor senses that the door is in the closed position and, wherein the controller is further configured to provide a warning if the handle sensor senses that the handle is in the locked position before at least one of the latch sensor senses the latch member is in the engaged position and the door sensor senses that the associated door is in the closed position.

2. The vehicle arrangement of claim 1, wherein the handle members are configured to pivot in a first direction as the latch members are moved from the disengaged position to the engaged position, and wherein the handle members are configured to pivot in a second direction that is different from the first direction as the handle members are moved from the unlocked position to the locked position.

3. The vehicle arrangement of claim 1, wherein at least one of the door sensors includes a proximity switch.

4. The vehicle arrangement of claim 1, wherein at least one of the latch sensors includes a proximity switch.

5. The vehicle arrangement of claim 1, wherein at least one of the handle sensors includes a proximity switch.

6. The vehicle arrangement of claim 1, wherein each latch member is one of two latch members associated with each of the first and second doors, wherein one of the two latch members is positioned proximate an upper edge of the associated door and the other of the two latch members is positioned proximate a lower edge of the associated door.

7. The vehicle arrangement of claim 6, wherein the two latch members are operably coupled to one another via a link member extending therebetween, and wherein the handle member is pivotably coupled to the link member.

8. A semitrailer comprising the vehicle arrangement of claim 1.

9. A method for sensing proper door latching, comprising:

providing a vehicle body;

providing a door operably coupled to the vehicle body and moveable between an open position and a closed position;

providing a latch arrangement, comprising:

a latch member moveable between an engaged position where the latch member operably engages the vehicle body preventing the door from being moved from the closed position to the open position, and a disengaged position where the latch member is operably disengaged from the vehicle body thereby allowing the door to be moved from the closed position to the open position; and a handle member disposed on an outside of the door, wherein the handle member is configured to be grasped by an operator from outside the vehicle body while the door is closed, and operably coupled to the latch member, the handle member moveable between a first position where the latch member is in the engaged position and a second position where the latch member is in the disengaged position, wherein the handle member is moveable between a locked position where the handle member is operably engaged with at least one of the door and the vehicle body thereby preventing the handle member from being moved from the first position to the second position and an unlocked position where the handle member is operably disengaged from the door and the vehicle body thereby allowing the handle member to be moved from the first position to the second position;

providing a sensor arrangement, comprising:

a door sensor located proximate the door and configured to sense when the door is in the closed position;

a latch sensor located proximate the latch member and configured to sense when the latch member is in the engaged position; and a handle sensor located proximate the handle member and configured to sense when the handle member is in the locked position; and providing a controller operably coupled to the door, latch and handle sensors;

sensing whether the door is in the closed position and communicating the same with the controller;

sensing whether the latch is in the engaged position and communicating the same with the controller;

sensing whether the handle member is in the locked position and communicating the same with the controller; and providing a warning if the latch sensor senses that the latch member is in the engaged position before the door sensor senses that the door is in the closed position.

10. The method of claim 9, wherein the step of providing a warning includes providing the warning to an operator if the handle sensor senses that the handle is in the locked position before at least one of the latch sensor senses the latch member is in the engaged position and the door sensor senses that the door is in the closed position.

11. The method of claim 9, wherein the latch member is one of a plurality of latch members, wherein the latch sensor is one of a plurality of latch sensors, and wherein each latch sensor of the plurality of latch sensors is configured to sense whether a corresponding one of the latch members is in the engaged position.

12. The method of claim 9, wherein the door is one of two doors, and wherein the door sensor is one of two door sensors that are configured to sense whether each of the two doors are in the closed position.

13. The method of claim 12, wherein the doors are configured such that one door must be moved to the closed position before the other door can be moved to the closed position; and including:

providing a warning if the second door is closed before the first door.

14. The method of claim 9, wherein the handle sensor is one of two handle sensors that are configured to sense whether each of the two handle members are in the locked position.

15. The method of claim 9, wherein the handle member is configured to pivot in a first direction as the latch member is moved from the disengaged position to the engaged position, and wherein the handle member is configured to pivot in a second direction that is different from the first direction as the handle member is moved from the unlocked position to the locked position.

16. The method of claim 9, wherein the door sensor includes a proximity switch.

17. The method of claim 9, wherein the latch sensor includes a proximity switch.

18. The method of claim 9, wherein the handle sensor includes a proximity switch.

19. A vehicle arrangement, comprising:

a vehicle body;

first and second doors, wherein each door is operably coupled to the vehicle body and moveable between an open position and a closed position and wherein the first and second doors are configured such that the first door must be moved to the closed position before the second door can be moved from the open position to the closed position in order to properly close the first and second doors;

a latch arrangement associated with each door, each latch arrangement comprising:

a latch member moveable between an engaged position where the latch member operably engages the vehicle body preventing the associated door from being moved from the closed position to the open position, and a disengaged position where the latch member is operably disengaged from the vehicle body thereby allowing the associated door to be moved from the closed position to the open position; and a handle member disposed on an outside of the associated door, wherein the handle member is configured to be grasped by an operator from outside the vehicle body while the associated door is closed, and operably coupled to the latch member, the handle member moveable between a first position where the latch member is in the engaged position and a second position where the latch member is in the disengaged position, wherein the handle member is moveable between a locked position where the handle member is operably engaged with at least one of the associated door and the vehicle body thereby preventing the handle member from being moved from the first position to the second position and an unlocked position where the handle member is operably disengaged from the associated door and the vehicle body thereby allowing the handle member to be moved from the first position to the second position;

a sensor arrangement associated with each door, each sensor arrangement comprising:

a door sensor located proximate the associated door and configured to sense when the associated door is in the closed position;

a controller operably coupled to the door sensors, and wherein the controller is configured to provide a warning if the door sensors sense that the second door was in the closed position before the first door was in the closed position; and wherein, each sensor arrangement further includes a handle sensor located proximate the handle member and configured to sense when the handle member is in the locked position.

20. The vehicle arrangement of claim 19, wherein each sensor arrangement includes: a latch sensor located proximate the first latch member and configured to sense when the latch member is in the engaged position.

21. The vehicle arrangement of claim 20, wherein the controller is configured to provide a warning if (a) the latch sensor senses that the latch member is in the engaged position before the door sensor senses that the associated door is in the closed position or if (b) the handle sensor senses that the handle is in the locked position before at least one of the latch sensor senses the latch member is in the engaged position and the door sensor senses that the associated door is in the closed position.

22. The vehicle arrangement of claim 21, wherein the handle members are configured to pivot in a first direction as the latch members are moved from the disengaged position to the engaged position, and wherein the handle members are configured to pivot in a second direction that is different from the first direction as the handle members are moved from the unlocked position to the locked position.

23. The vehicle arrangement of claim 19, wherein at least one of the door sensors includes a proximity switch.

24. The vehicle arrangement of claim 20, wherein at least one of the latch sensors includes a proximity switch.

25. The vehicle arrangement of claim 20, wherein at least one of the handle sensors includes a proximity switch.

26. The vehicle arrangement of claim 19, wherein each latch member is one of two latch members associated with each of the first and second doors, wherein one of the two latch members is positioned proximate an upper edge of the associated door and the other of the two latch members is positioned proximate a lower edge of the associated door.

27. The vehicle arrangement of claim 26, wherein the two latch members are operably coupled to one another via a link member extending therebetween, and wherein the handle member is pivotably coupled to the link member.

28. A semitrailer comprising the vehicle arrangement of claim 19.

* * * * *